US007228987B2

(12) United States Patent
Jones

(10) Patent No.: US 7,228,987 B2
(45) Date of Patent: Jun. 12, 2007

(54) KRAZY KOOZIE

(76) Inventor: Kyle Brandon Jones, 1444 Rugged Oaks Rd., Glen Rose, TX (US) 76043

( * ) Notice: Subject to any disclaimer, the term of this patent is extended or adjusted under 35 U.S.C. 154(b) by 355 days.

(21) Appl. No.: 10/732,866

(22) Filed: Dec. 10, 2003

(65) Prior Publication Data

US 2004/0173625 A1 Sep. 9, 2004

Related U.S. Application Data

(60) Provisional application No. 60/432,206, filed on Dec. 11, 2002.

(51) Int. Cl.
*B65D 25/34* (2006.01)

(52) U.S. Cl. ..... 220/739

(58) Field of Classification Search ..... None
See application file for complete search history.

(56) References Cited

U.S. PATENT DOCUMENTS 1,395,485 A * 11/1921 Duncan et al. ..... 48/4
1,736,383 A * 11/1929 Waggoner ..... 150/154
4,293,015 A 10/1981 McGough ..... 150/52 R
4,548,349 A 10/1985 Tunberg ..... 229/1.5 H
4,648,525 A 3/1987 Henderson ..... 220/85 H
5,147,067 A 9/1992 Effertz ..... 220/739
5,222,656 A 6/1993 Carlson ..... 229/1.5 H
5,564,568 A * 10/1996 Rankin, Sr. ..... 206/446
5,985,383 A * 11/1999 Allen et al. ..... 428/34.1
6,510,627 B1 * 1/2003 Liu ..... 36/50.1
2002/0036206 A1 * 3/2002 Bergman et al. ..... 220/754

* cited by examiner

*Primary Examiner*—Stephen J. Castellano

(57) ABSTRACT

The purpose of the Krazy koozie is to provide the consumer with an apparatus intended for use with beverage containers of various sizes and shapes. The Krazy koozie performs functions of prior existence regarding protecting the hand of the consumer when holding a hot beverage cup, providing insulation to a cold beverage container, collapsible storage capabilities, preventing condensation stains on preferred surfaces, but combines all existing functions with the ability to expand and contract easily around various beverage containers. Unlike existing products on the market, the Krazy koozie combines all the desired functions of existing apparatuses allowing a consumer to use my invention during most situations with many beverage containers. The existing market is lacking of a universal apparatus for insulating a beverage container, my invention introduces this idea and provides many opportunities to not only consumers, but those currently involved in the market as it exists today.

1 Claim, 3 Drawing Sheets

KRAZY KOOZIE

On this day, Oct. 24, 2003, I Kyle Brandon Jones submit this non-provisional utility patent application to the USPTO claiming priority of the filing date, Dec. 11, 2002, of provisional patent application No. 60/432,206. As set forth in Title 35, United States Code, Section 184, a license has been granted on the date of Dec. 11, 2002, to the applicant Kyle Brandon Jones and the boundaries of such license set forth in Title 37, Code of Federal Regulations, 5.15(a). As such license has been granted, I Kyle Brandon Jones claim Kyle Brandon Jones as first named inventor of said invention, Krazy koozie.

REFERENCES CITED

| U.S. Patent Documents | | | |
|---|---|---|---|
| 5,222,656 | June, 1993 | Carlson | 229/403 |
| 4,648,525 | March, 1987 | Henderson | 220/739 |
| 4,548,349 | October, 1985 | Tunberg | 229/800 |
| 4,293,015 | October, 1981 | McGough | 220/739 |
| 5,147,067 | September, 1992 | Effertz | 220/739 |

STATEMENT REGARDING FEDERALLY SPONSORED RESEARCH AND DEVELOPMENT

Not Applicable

REFERENCE TO SEQUENCE LISTING, A TABLE, OR A COMPUTER PROGRAM LISTING COMPACT DISC

APPENDIX

Not Applicable

BACKGROUND OF INVENTION

Various types of insulating jackets and sleeves have been created and marketed for the purposes of keeping various beverage containers hot or cold as well as hindering condensation that frequently forms on the outside of a cold beverage container. Sleeves such as that invented by Carlson (U.S. Pat. No. 5,222,656), intended for insulating the hand while holding a beverage cup, lacks the insulating material needed in order to maintain the temperature of the liquid within the beverage cup. Much like Carlson's sleeve, Tunberg's (U.S. Pat. No. 4,548,349) intended use is that of fitting a beverage cup as well, however, instead of concentrating on protecting the hand when holding a hot beverage within a cup Tunberg focused on protecting the cup when making confectionary drinks. Both Tunberg's and Carlson's sleeves lack the capability to collapse for easy storage as well as to fit around various sizes and shapes of beverage containers. Other beverage container holders such as that invented by Henderson (U.S. Pat. No. 4,648,525), intended for easily storing when not in use as well as claiming a support base, lacks the capability to fit various beverage containers due to it's "substantially rectangular body portion" and is limited to that of a cylindrical beverage container. Much like the problems mentioned with Henderson's invention, McGough's (U.S. Pat. No. 4,293,015) invention although also claiming the ability to collapse, lacks as Henderson's with the inability to fit around various sizes and shapes of beverage containers. As I have shown, many varying products concern themselves with varying functions without being capable of performing them all. This invention has the ability to fit various beverage containers such as: a 12 oz. aluminum can or glass bottle, a 16 oz. plastic bottle, a 12 oz. or 16 oz. cup, a 22 oz. aluminum can or bottle, as well as many other sizes of cups with varying circumferences. This invention has a collapsible base for easy storage, can be used when making confectionary drinks, keeps various beverage containers hot or cool, hinders condensation stains due to it's base, as well as protecting ones hand when consuming a hot beverage. As all prior art limits itself to few functions and capabilities, this invention combines multiple functions and presents them in a single design.

BRIEF SUMMARY OF THE INVENTION

The current invention pertains to an apparatus for insulating beverage containers of various sizes conveniently during the majority of situations. The apparatus consists of two insulated flexible pieces of material, one existing as primarily rectangular, where as the second connects at its lower end to the bottom center edge of the primarily rectangular piece by means of a snap mechanism and drastically takes form as a mainly round base before it drastically tapers to a narrow rectangular strip and slightly tapers upward and outward towards the second pieces upper edge. The two pieces are joined together at the lower opposing ends of the primarily rectangular piece and the narrow strip between the round base portion and the upper end portion in a manner in which allows the apparatus, in combination with the cord, pull clamp, eyelet system, to vary diameter throughout the main body structure. The present invention provides an fluctuating apparatus for insulating various sizes and shapes of beverage containers such as: a 12 oz. aluminum can or glass bottle, a 12 or 16 oz. plastic bottle, a 22 oz. glass bottle or aluminum can, a 12 oz. or 16 oz. plastic, paper, or glass cup as well as any cup with a similar diameter at its base and a similar upward taper from the base to its upper edge with no limitations on height. The above mentioned prior art provide many varying functions but are all limited by their design to fit the amount of beverage containers that this present invention's capable of executing.

DETAILED DESCRIPTION OF THE INVENTION

Figure 1:
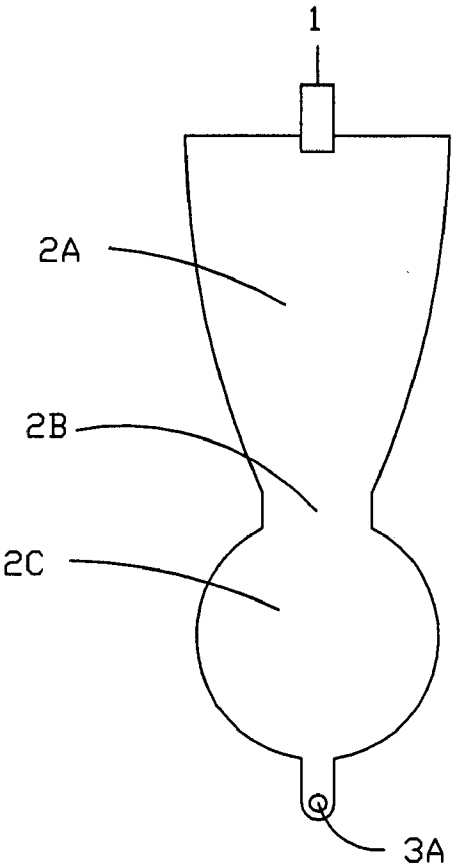
FIG. 1 is a perspective of one of the two main pieces making up the invention, the view shows the shape of the tongue/base portion as well as showing its direct relationship to the pull tab and the male portion of the snap mechanism.

Referring to FIG. 1 the tongue portion 2A, the strip portion 2B, and the base portion 2C make up one of the two main body pieces. The pull tab 1 extends upward from the center top edge of the tongue portion 2A allowing the consumer to realign the free moving tongue portion 2A as a beverage container is being introduced into the main structure of said invention. The male portion 3A of the snap mechanism 3A & 3B extends downward from the center edge of the base portion 2C creating a second means to connect the two main body pieces as well as to create a means in which the said invention can be collapsed.

Figure 2:
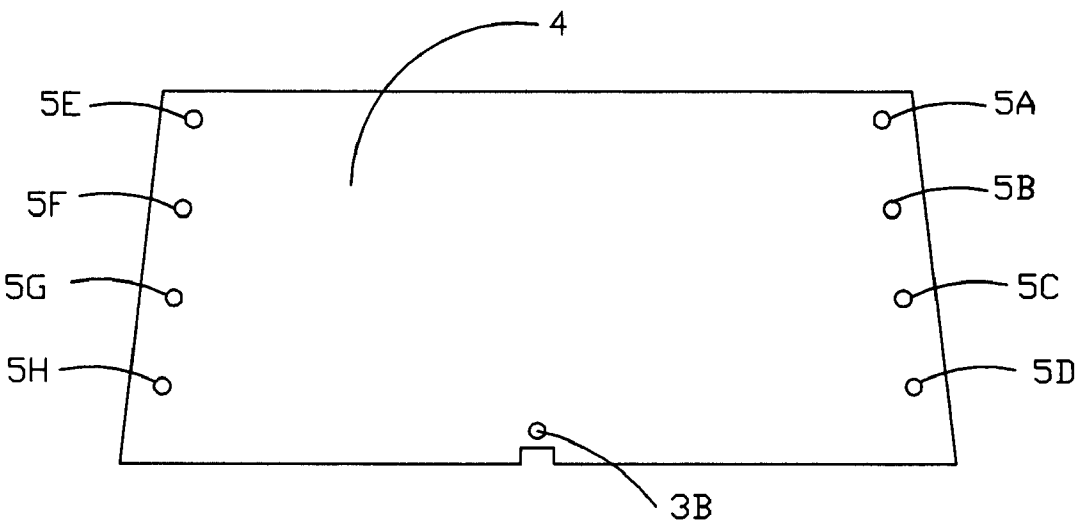
FIG. 2 is a perspective of the second main piece that makes up the invention, the view shows the main body pieces shape as well as its direct relationship with the eyelets and female portion of the snap mechanism and notch.

In FIG. 2 the slightly skewed rectangular main body portion 4 is seen in direct relation with the eyelets 5A 5B 5C 5D 5E 5F 5G 5H. The female portion 3B of the snap mechanism 3A & 3B is shown at the bottom center edge of the rectangular main body portion in association with the male portion 3A allows a means of support as it joins the rectangular main body 4 to the base portion 2C as well as allowing the invention to be collapsed for easy storage.

Figure 3:
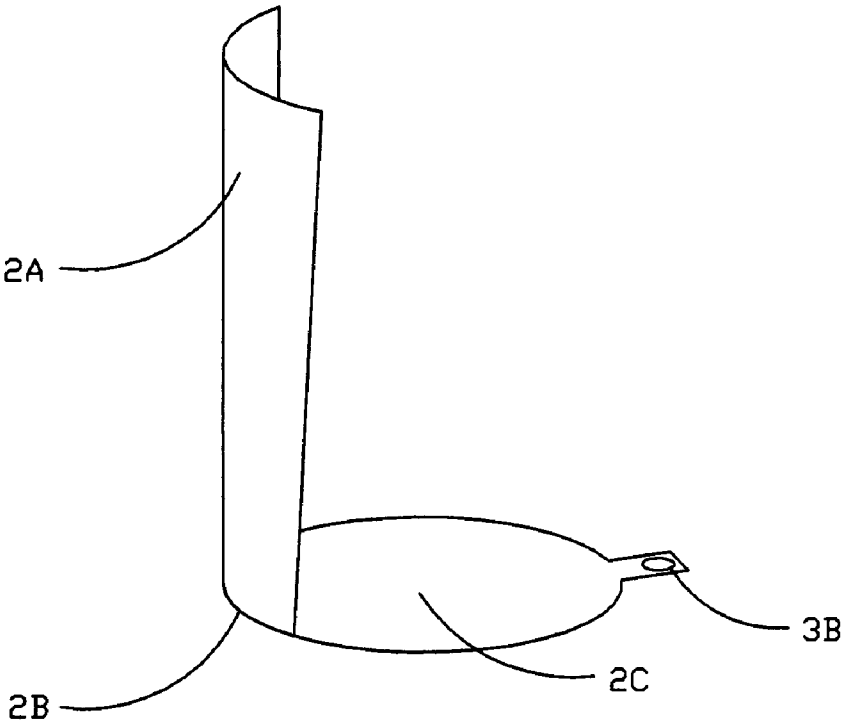
FIG. 3 is a side perspective showing the tongue/base portion of the main body in an upright position as to show its direct relationship to FIG. 4.

As FIG. 1, FIG. 3 shows the tongue portion 2A, strip portion 2B, and the base portion 2C, as well as the male portion 3B of the snap mechanism 3A & 3B, but instead shows the main body piece in its upright position instead of laying flat.

Figure 4:
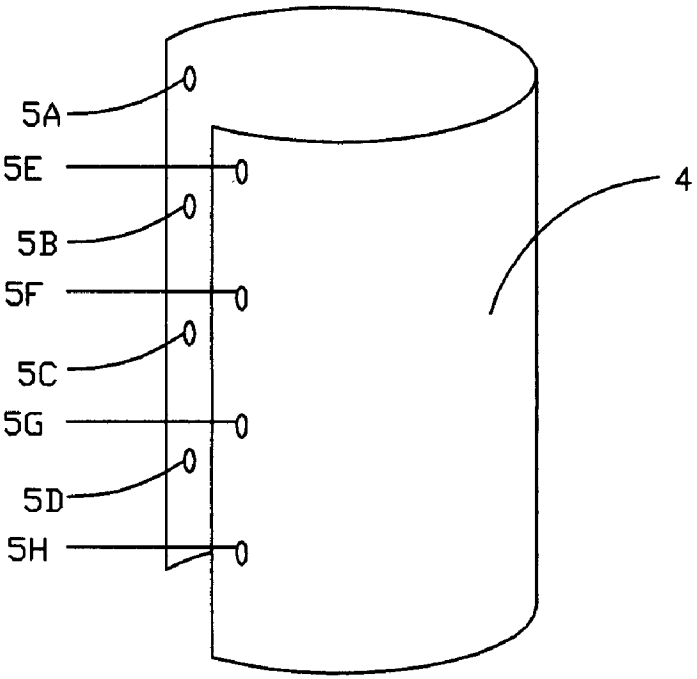
FIG. 4 shows the opposing side of FIG. 3, as to show the slightly skewed rectangular main body portion in an upright position as to show its direct relationship to FIG. 3.

As FIG. 2, FIG. 4 shows the rectangular portion 4 along with the eyelets 5A 5B 5C 5D 5E 5F 5G 5H in its upright position. FIG. 4 shows a direct upright relationship with FIG. 3 as to give a general idea of the final form of said invention.

Figure 5:
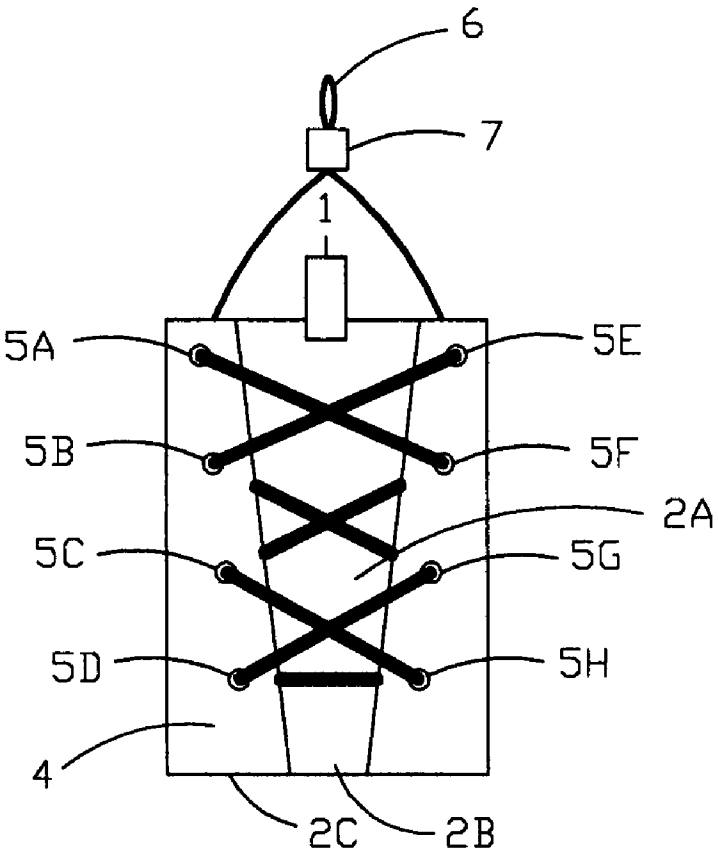
FIG. 5 shows an upright frontal view of the two main body pieces in final form as to show the relationship of the pieces of the said invention.

FIG. 5, showing the frontal view of the final form of said invention introduces all remaining pieces and their direct proximity to each piece of said invention. As FIG. 3 and FIG. 4 are joined together at the bottom opposing corners of the rectangular main body piece 4 and the strip portion 2B second main body piece, the final form of said invention takes shape as FIG. 5. The cord 6 is then guided by the eyelets 5A 5B 5C 5D 5E 5F 5G 5H beginning with the bottom two opposing eyelets 5D 5H crisscrossing upwards until exiting the upper two eyelets 5A 5E and finally through the pull clamp mechanism 7. The cord 6 and pull clamp 7, in association with the eyelets 5A 5B 5C 5D 5E 5F 5G, tongue portion 2A, strip portion 2B, and rectangular main body portion 4, allow the invention to fluctuate its circumference beginning with its upper edge and tapering down throughout the main structure. The tongue portion 2A extends upward overlapped by the rectangular main body portion 4 and held into place by the cord 6, in direct relationship with the eyelets 5A 5B 5C 5D 5E 5F 5G 5H, as well as the points in which the strip portion 2B connects to the rectangular main body portion 4. The rectangular main body portions 4 eyelets 5A 5B 5C 5D 5E 5F 5G 5H in association with the cord 6 keep any slack from existing between the preferred beverage container and the inner wall of said rectangular body portion 4, tongue portion 2A, as well as the base portion 2C. When preferred beverage container is introduced into the main structure, the pull tab 1 allows the consumer to apply an upward pressure as the beverage container is being pushed downward.

Figure 6:
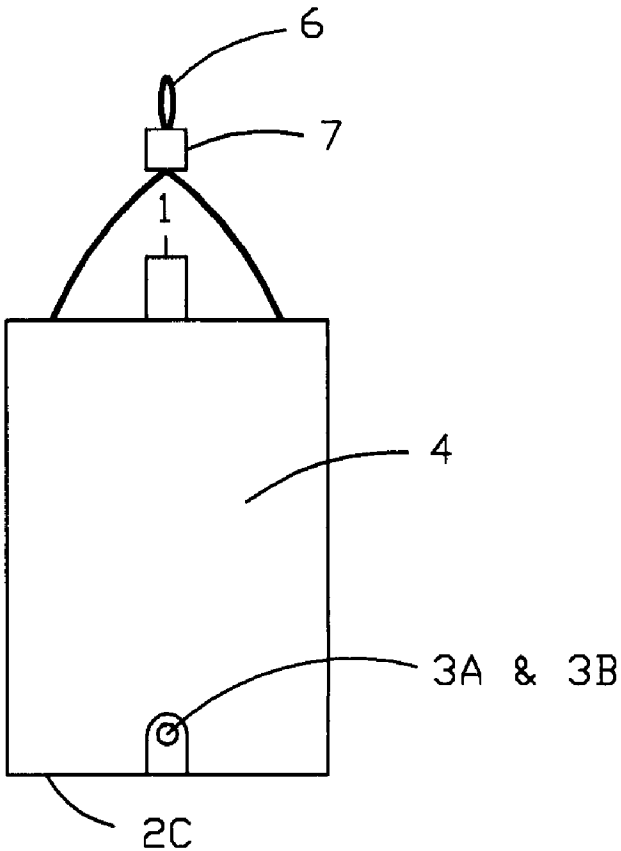
FIG. 6 shows an upright rear view of the two main body pieces in final form as to show the relationship of pieces of the said invention.

In FIG. 6, the upright rear view shows the base portion 2C along with the male portion 3A of the snap mechanism 3A & 3B connected to the rectangular main body structure 4 along with the female portion 3B of the snap mechanism 3A & 3B. The snap mechanism 3A & 3B allows the base portion 2C and the rectangular main body piece 4 to be disconnected, enabling the base portion 2C to fit up inside the main structure behind the tongue portion 2A of FIG. 5 allowing the consumer to collapse the invention for easy storage. The base portion 2C in direct relation ship with the snap mechanism 3A & 3B creates a slightly free moving base allowing the bottom edge of the rectangular main body piece 4 a certain extent of expansion and contraction.

I claim:

1. An apparatus for insulating a beverage container, comprising:

a flexible body defining a cavity adapted to receive the beverage container, a first edge, a second edge generally facing the first edge, and a base end, the flexible body further defining at least one eyelet along the first edge of the flexible body and at least one eyelet along the second edge of the flexible body;

a flexible base portion defining a base, a tongue, and a strip disposed between the base and the tongue, the base being disposed at the base end of the flexible body, the flexible base portion being bent at the strip such that the tongue is disposed in the cavity of the flexible body adjacent the first edge and the second edge;

a snap mechanism having a first portion attached to the base and a second portion attached to the flexible body proximate the base end of the flexible body;

a pull clamp;

a cord laced through the eyelets and extending through the pull clamp, such that the cord and the pull clamp, when operated, retain the beverage container in the cavity; and a pull tab extending from the tongue.

* * * * *